US008793880B2

(12) United States Patent
Taub et al.

(10) Patent No.: US 8,793,880 B2
(45) **Date of Patent: *Aug. 5, 2014**

(54) SHAVING RAZOR ADAPTER ATTACHING A SHAVING RAZOR CARTRIDGE TO A SHAVING RAZOR HANDLE

(75) Inventors: Stew L. Taub, Needham, MA (US); Andrew Russell Keene, Stoneham, MA (US); William Thomas O'Connor, Londonderry, NH (US); Alejandro Carlos Lee, Cambridge, MA (US)

(73) Assignee: The Gillette Company, Boston, MA (US)

( * ) Notice: Subject to any disclaimer, the term of this patent is extended or adjusted under 35 U.S.C. 154(b) by 629 days.

This patent is subject to a terminal disclaimer.

(21) Appl. No.: 12/706,462

(22) Filed: Feb. 16, 2010

(65) Prior Publication Data

US 2011/0197450 A1 Aug. 18, 2011

(51) Int. Cl.
*B26B 21/00* (2006.01)

(52) U.S. Cl.
USPC ..... 30/50; 30/32; 30/47; 30/527

(58) Field of Classification Search
CPC ..... B26B 21/06
USPC ..... 30/32, 47, 50, 527
See application file for complete search history.

(56) References Cited

U.S. PATENT DOCUMENTS

| | | | | |
|---|---|---|---|---|
| 2,299,416 | A * | 10/1942 | Testi | 30/40.2 |
| 4,739,553 | A * | 4/1988 | Lazarchik | 30/47 |
| 5,157,834 | A * | 10/1992 | Chen et al. | 30/85 |
| 5,784,790 | A | 7/1998 | Carson, III et al. | |
| 5,787,586 | A | 8/1998 | Apprille, Jr. et al. | |
| 6,122,826 | A * | 9/2000 | Coffin et al. | 30/57 |
| 6,223,442 | B1 * | 5/2001 | Pina | 30/527 |
| 6,581,290 | B1 * | 6/2003 | Fishel | 30/50 |
| 6,880,253 | B1 * | 4/2005 | Gyllerstrom | 30/527 |
| 7,168,173 | B2 * | 1/2007 | Worrick, III | 30/527 |
| 8,327,544 | B2 * | 12/2012 | De Klerk et al. | 30/41 |
| 2002/0189112 | A1 * | 12/2002 | Peyser | 30/527 |
| 2006/0260131 | A1 * | 11/2006 | Follo | 30/50 |
| 2007/0251106 | A1 | 11/2007 | Gladstone | |
| 2008/0034589 | A1 * | 2/2008 | Nearing | 30/32 |
| 2009/0288299 | A1 * | 11/2009 | Denkert et al. | 30/50 |
| 2010/0299927 | A1 | 12/2010 | Fischer et al. | |

OTHER PUBLICATIONS

PCT International Search Report dated May 26, 2011.

* cited by examiner

*Primary Examiner* — Katherine Mitchell
*Assistant Examiner* — Marcus Menezes
(74) *Attorney, Agent, or Firm* — Jay A. Krebs

(57) ABSTRACT

A shaving razor adapter used to attach a disposable shaving razor cartridge of a first shaving razor configuration to a shaving razor handle of a second shaving razor configuration. The shaving razor adapter includes a first attachment portion which resembles the connecting end of the shaving razor handle of the first shaving razor configuration. The first attachment portion attaches the adapter to the shaving razor cartridge of the first shaving razor configuration. The second attachment portion of the adapter resembles the connecting member of a shaving razor cartridge of a second shaving razor configuration that interfaces with the connecting end of the handle of the second shaving razor configuration. The second attachment portion of the adapter releasably attaches the adapter to the connecting end of the shaving razor handle of the second shaving razor configuration.

16 Claims, 11 Drawing Sheets

SHAVING RAZOR ADAPTER ATTACHING A SHAVING RAZOR CARTRIDGE TO A SHAVING RAZOR HANDLE

FIELD OF THE INVENTION

The present invention relates to shaving razors and particularly to a shaving razor adapter for attaching a disposable shaving razor cartridge to a shaving razor handle. More particularly, the present invention relates to a shaving razor adapter attaching a shaving razor cartridge of a first shaving razor configuration to a shaving razor handle of a second shaving razor configuration. The second shaving razor configuration is different than the first shaving razor configuration.

BACKGROUND OF THE INVENTION

In recent years shaving razors with various numbers of blades have been proposed in the patent literature and commercialized such as the three-bladed Mach 3™ razor and the five bladed Fusion™ razor by The Gillette Company. In addition to the number of blades, the Mach 3™ shaving razor configuration is significantly different than the Fusion™ shaving razor configuration. For instance, the Fusion™ blade cartridges include a trimmer assembly and a connecting member which will not attach to the shaving razor handle of the Mach 3™ configuration.

The Fusion™ shaving razor design is marketed as a product improvement over the predecessor Mach 3™ shaving razor design due to improved shaving efficiency attributed to the additional blades and also improved functionality resulting from added features such as a trimmer assembly including a trimmer blade for manicuring side burns and other facial hair. Getting consumers to try improved shaving razor product designs is challenge particularly if the change affects the consumer's shaving habits. For instance, a consumer may be comfortable with a particular shaving razor handle design and be reluctant to change if it means using a new shaving razor handle design.

Manufacturers often provide free sample of new product designs to consumers as a means of encouraging them to try the new products. When improvements to the shaving razor design include both the cartridge and the handle, the cost of providing free samples can be excessive. In addition, such samples are often provided with the previous product configuration which complicates packaging. Since the consumer is primarily concerned with the shaving razor cartridge, it would be advantageous to the manufacturer to offer a sample of the new razor cartridge along with the old razor cartridge at the point of sale. Since shipping a new razor handle configuration along with the cartridge increases cost and complicates packaging, it is desirable to provide an adapter along with a new shaving razor cartridge design that enables the consumer to try the new razor cartridge on an old and different shaving razor handle configuration.

SUMMARY OF THE INVENTION

In one aspect, the invention features, in general, a shaving razor adapter for attaching a disposable shaving razor cartridge of a first shaving razor configuration to a shaving razor handle of a second shaving razor configuration. The shaving razor cartridge comprises a housing having a front edge and a rear edge with one or more shaving blades disposed therebetween. A cam surface is disposed opposite the one or more shaving blades. The shaving razor cartridge includes a connecting member configured to connect the housing to a connecting end of a shaving razor handle of the first shaving razor configuration. The connecting member includes a deflectable element defining at least a portion of an opening through the connecting member.

The shaving razor adapter comprises a first attachment portion which resembles the connecting end of the shaving razor handle of the first shaving razor configuration. The first attachment portion attaches the adapter to the shaving razor cartridge. The first attachment portion includes a projection sized to be received by the opening extending through the connecting member of the shaving razor cartridge. The projection has an enlarged distal end and angled side surfaces extending from the distal end to a base. The angled side surfaces have a projected apex angle of between 45 and 60 degrees such that the base is smaller than the enlarged distal end. The enlarged distal end of the projection has a dimension greater than a dimension of the opening such that inserting the projection into the opening deflects the deflectable element to secure the connecting member to the first attachment portion. The shaving razor adapter further comprises a second attachment portion opposite the first attachment portion. The second attachment portion of the adapter resembles the connecting member of a shaving razor cartridge of a second shaving razor configuration that interfaces with the connecting end of the handle of the second shaving razor configuration. The second attachment portion of the adapter releasably attaches the adapter to the connecting end of the shaving razor handle of the second shaving razor configuration.

In one embodiment the adapter includes a leaf spring attached to the first attachment portion. The leaf spring extends through the opening in the connecting member of the shaving razor cartridge and interfaces with the cam surface on the housing of the shaving razor cartridge to bias the housing.

In another embodiment, the adapter includes a spring biased plunger attached to the first attachment portion. The spring biased plunger extends through the opening in the connecting member and includes a cam follower surface that interfaces with the cam surface on the housing of the shaving razor cartridge to bias the housing.

In another embodiment, the shaving razor handle of the second shaving razor configuration comprises a cartridge support structure comprising an asymmetrically shaped extension and a spring biased plunger including a cam follower surface extending from the extension. The projection of the first attachment portion includes an aperture through the distal end and a slidable plunger having a first end comprising a cam follower extending through the aperture and a second end slidably mounted to the first attachment portion. The second attachment portion of the adapter comprises a central base structure having an asymmetrically shaped recess configured to interface with the asymmetrically shaped extension of the cartridge support structure. The asymmetrically shaped recess extends through the adapter from the second attachment portion to the first attachment portion. The asymmetrically shaped extension including the spring biased plunger is connected to the recess in the second attachment portion of the adapter such that the cam follower surface of the spring biased plunger interfaces with the second end of the slidable plunger slidably mounted in the first attachment portion. The cam follower surface of the slidable plunger interfaces with the cam surface on the housing of the shaving razor cartridge to bias the housing.

In another embodiment, a shaving razor cartridge packaging kit is provided. The shaving razor cartridge packaging kit comprises a disposable shaving razor cartridge of a first shaving razor configuration and a shaving razor adapter. The shaving razor adapter attaches the disposable shaving razor cartridge of the first shaving razor configuration to a shaving razor handle of a second shaving razor configuration. The shaving razor cartridge and the shaving razor adapter are packaged in a common package.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

The shaving razor adapter according to the present invention will be described with reference to the following figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

Figure 1A:
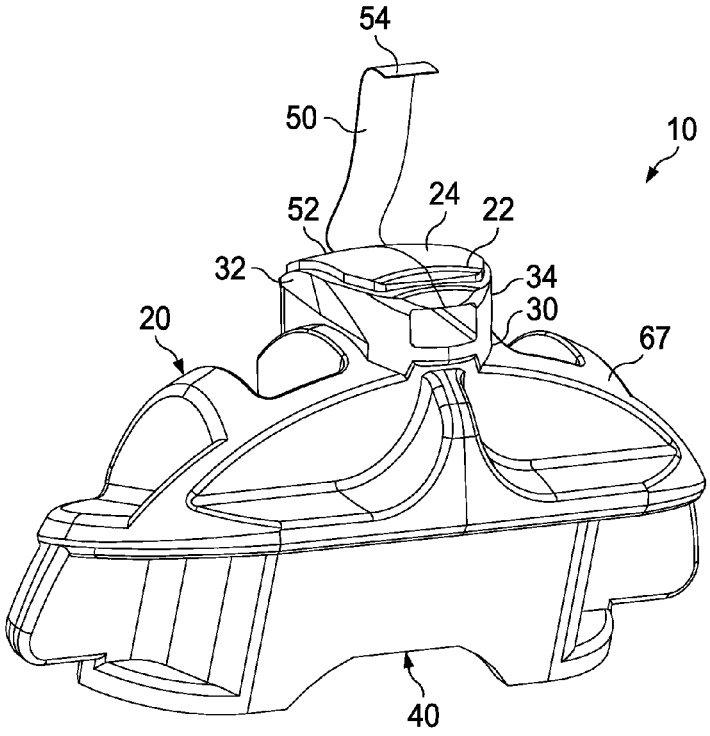
FIG. 1*a* is a perspective view of the forward end of the adapter according to the present invention.
Figure 1B:
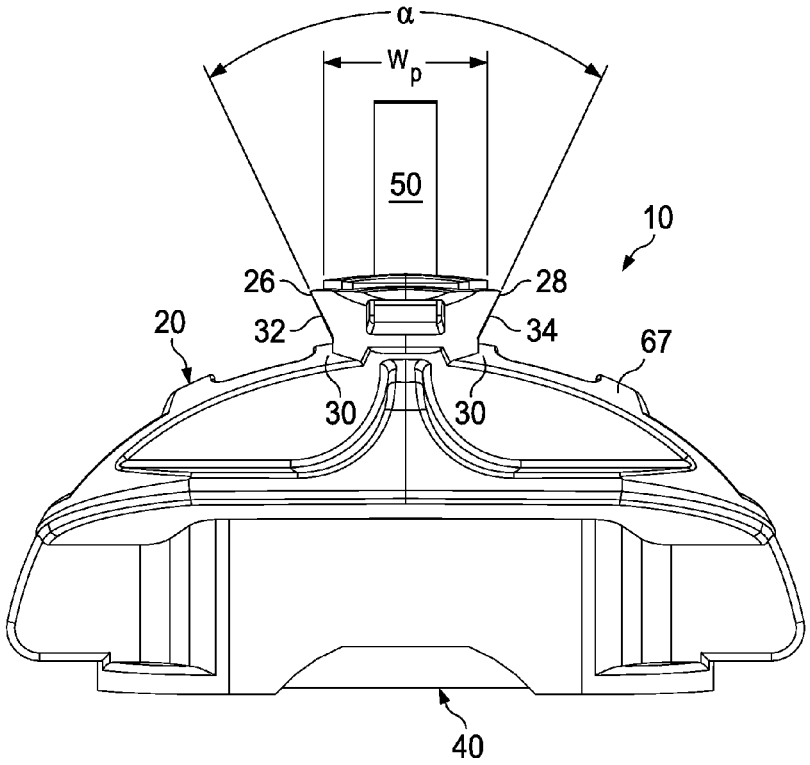
FIG. 1*b* is a top view of the shaving razor adapter according to the present invention.
Figure 8:
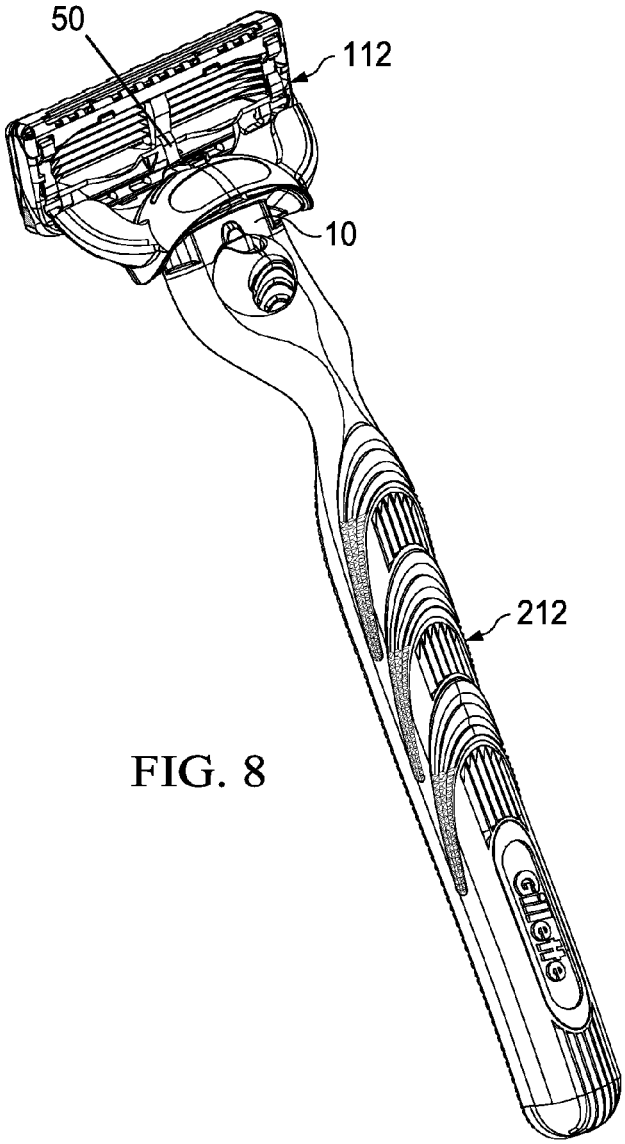
FIG. 8 is a perspective view of a shaving razor cartridge of a first shaving razor configuration attached to a handle of a second shaving razor configuration via the shaving razor adapter according to the present invention.

Referring to FIGS. 1*a*-1*b*, shaving razor adapter 10 according to the present invention includes a first attachment portion 20 configured to attach to a disposable shaving razor cartridge of a first shaving razor configuration and a second attachment portion 40 configured to attach to a shaving razor handle of a second shaving razor configuration. FIG. 8 shows the shaving razor adapter 10 attaching a shaving razor cartridge 112 of the first shaving razor configuration to a handle 212 of the second shaving razor configuration 210. The first and second shaving razor configurations are fully described below.

Figure 1C:
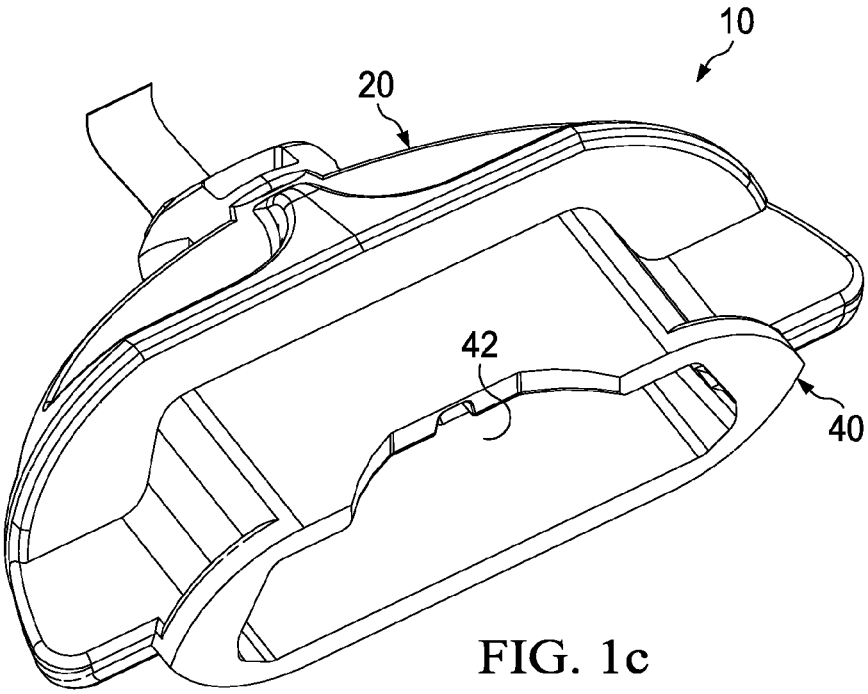
FIG. 1*c* is a perspective view of the aft side of the shaving razor adapter according to the present invention.
Figure 1D:
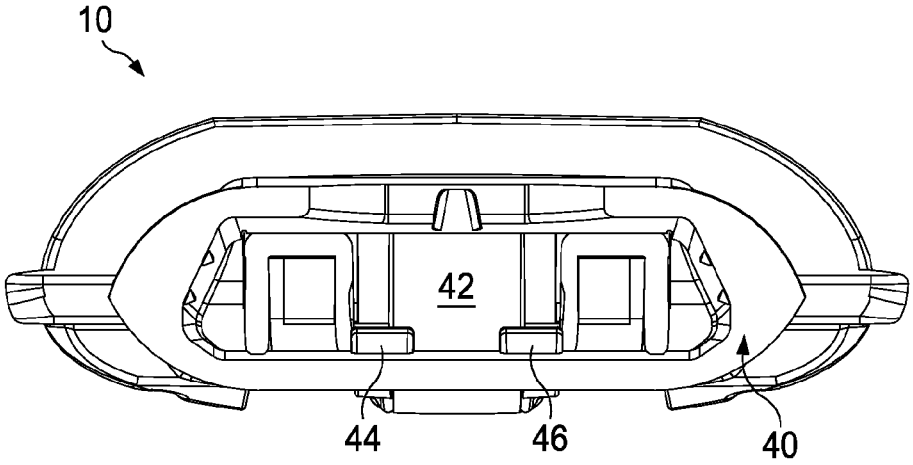
FIG. 1*d* is a back view of the aft side of the shaving razor adapter according to the present invention.
Figure 2A:
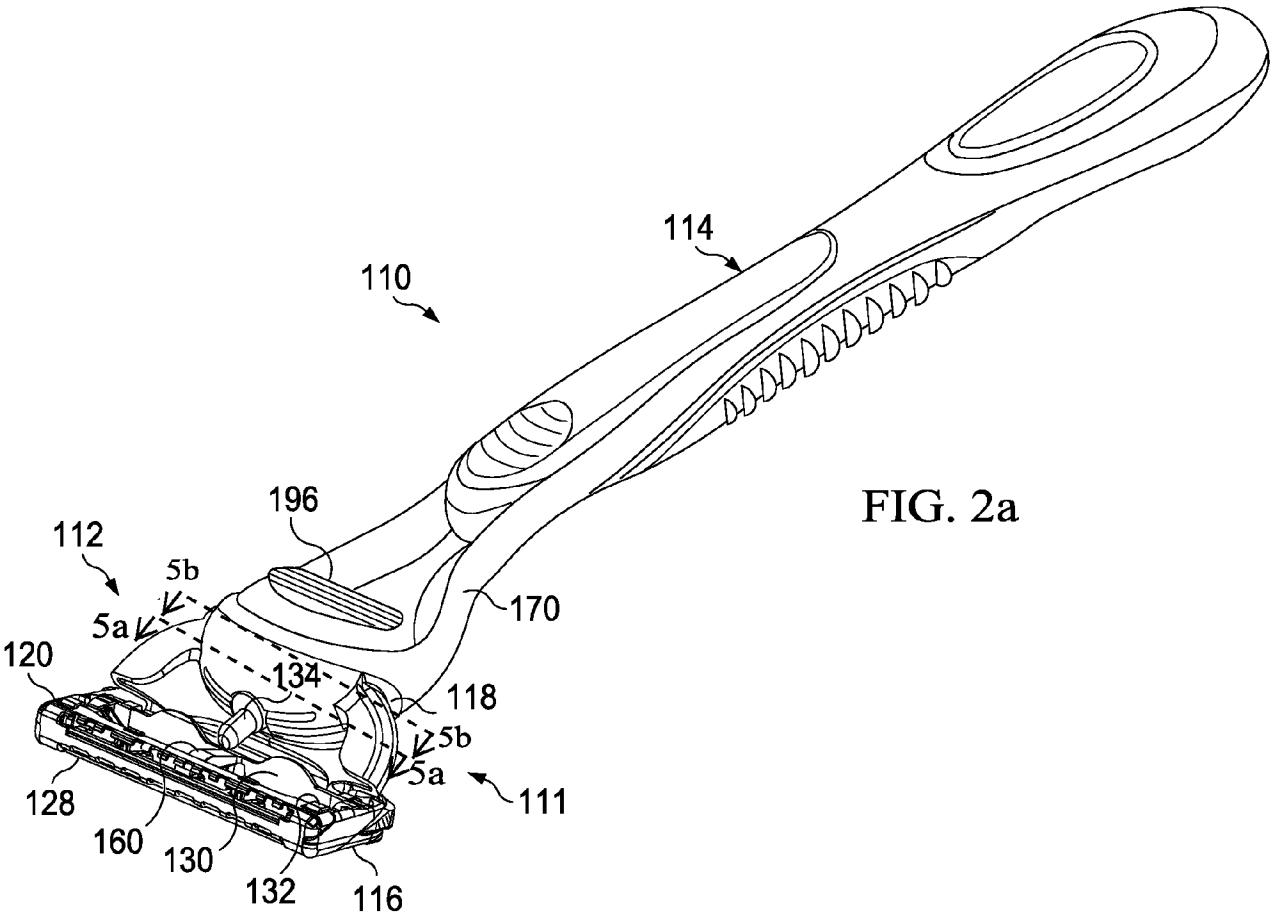
FIG. 2*a* and FIG. 2*b* are perspective views of a first shaving razor configuration.
Figure 2B:
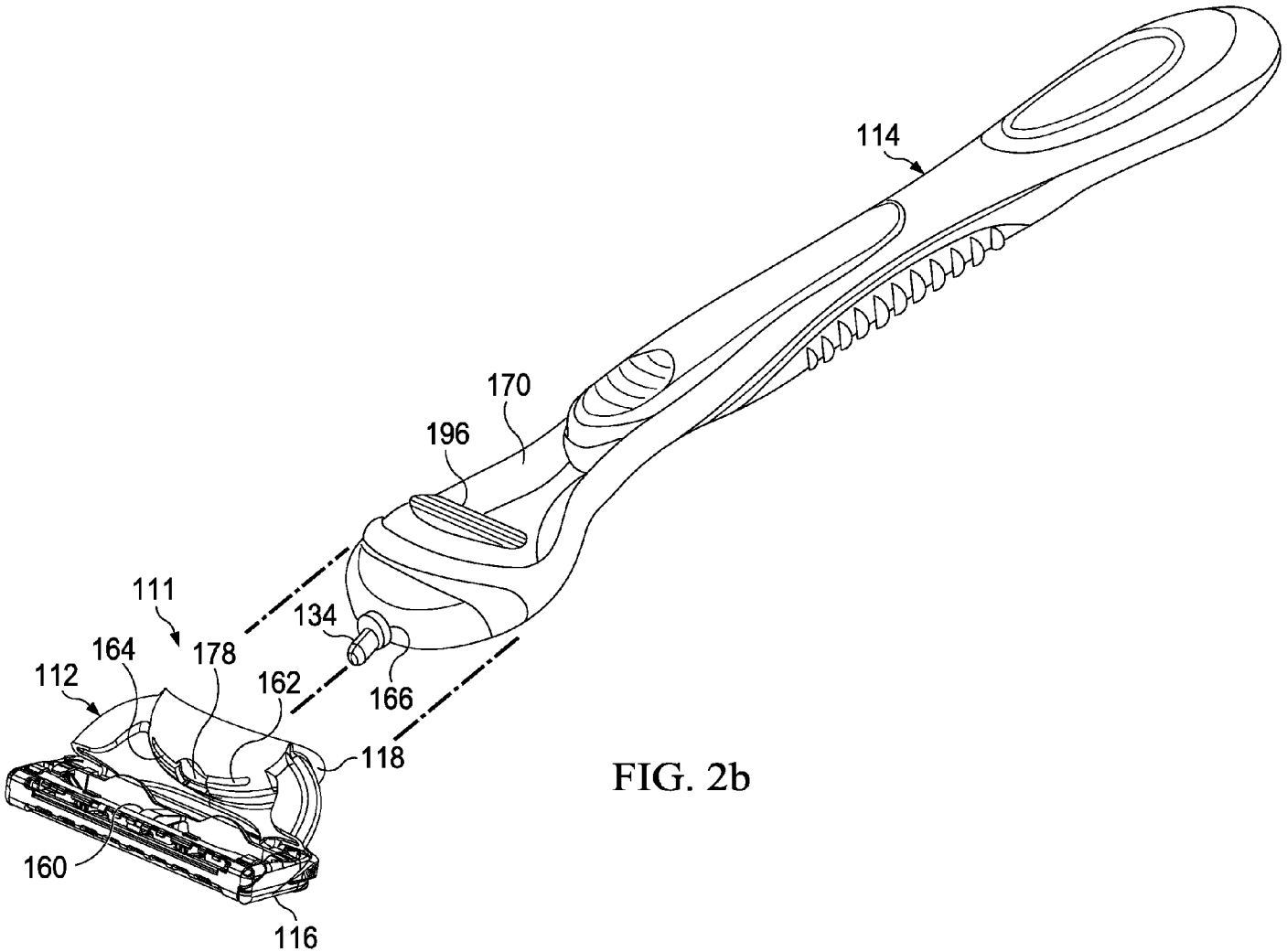
Figure 3:
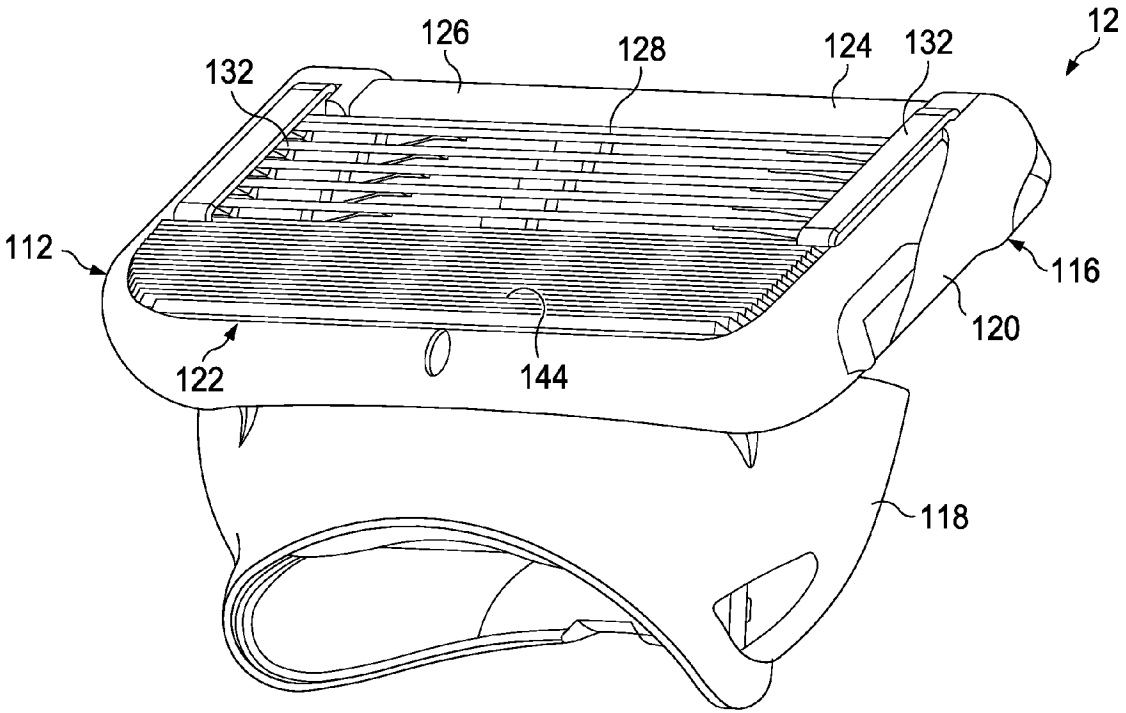
FIG. 3 is a perspective view of a shaving razor cartridge of the first shaving razor configuration shown in FIGS. 2*a* and 2*b*.

Referring to FIGS. 2*a* and 2*b*, first shaving razor configuration 110 includes disposable shaving razor cartridge 112 and shaving razor handle 114. Cartridge 112 includes a connecting member 118, which connects to handle 114, and a blade unit 116 which is pivotally connected to connecting member 118. The connecting member 118 includes deflectable latches 162 and 164 defining at least a portion of an opening 178 through the connecting member. Referring to FIG. 3, blade unit 116 includes plastic housing 120, primary guard 122 at the front of housing 120 and primary cap 124 at the rear of housing 120. The primary guard 122 may have a plurality of fins 144 spaced apart from each other that extend longitudinally along a length of the housing 120. The primary cap 124 may have a lubricating strip 126. Elongated primary shaving blades 128 are positioned between primary guard 122 and primary cap 124. A cam surface 160 is shown in FIG. 1 disposed on the housing opposite the one or more shaving blades. Although five primary shaving blades 128 are shown, it is understood that more or less primary shaving blades 128 may be mounted within the housing 120. The blades 128 are shown secured within the housing 120 with clips 132; however, other assembly methods known to those skilled in the art may also be used. These and other features of first shaving razor configuration 110 are described in U.S. Pat. No. 7,168,173.

As shown in FIG. 2*b*, the connecting member 118 of the first shaving razor configuration removably connects the blade unit 116 to a handle connecting structure 111 on handle 114. Connecting structure 111 includes a projection 166 and a plunger 134 the combination which extends through opening 178 in connecting member 118 such that the plunger 134 interfaces with cam surface 160. For the present invention, the first attachment portion 20 of the shaving razor adapter 10 resembles handle connecting structure 111 on handle 114 so that connecting member 118 connects blade unit 116 to the first attachment portion 20 of the shaving razor adapter 10. As discussed more fully below, the connection member 118 may be removably attached or non removably attached to the first attachment portion 20.

Figure 4A:
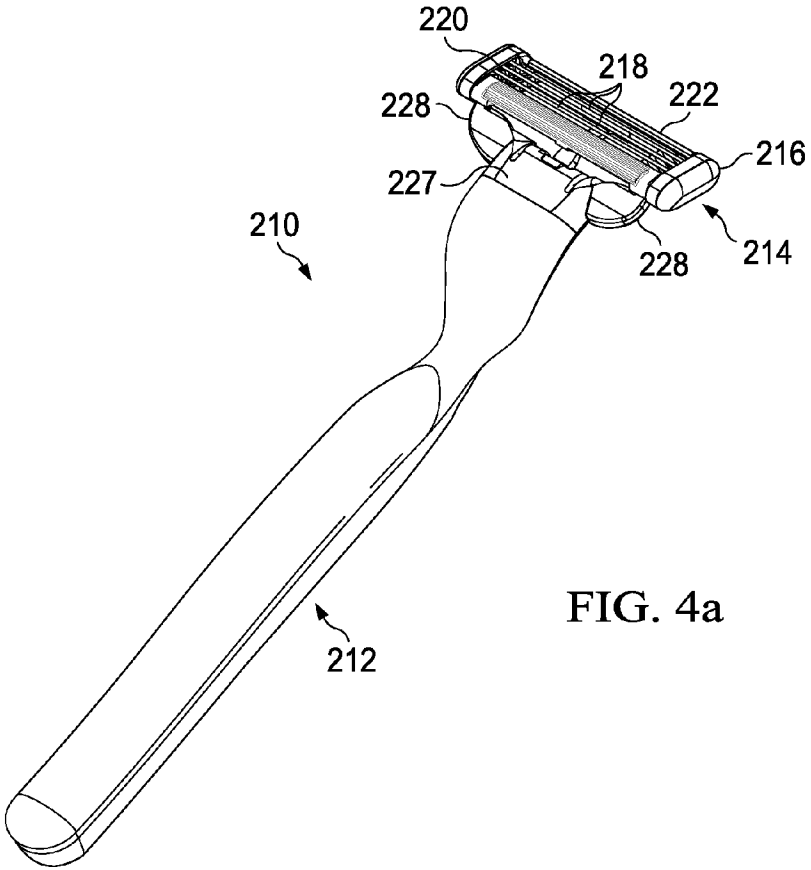
FIG. 4*a* and FIG. 4*b* are perspective views of the second shaving razor configuration.
Figure 4C:
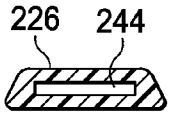
Figure 4B:
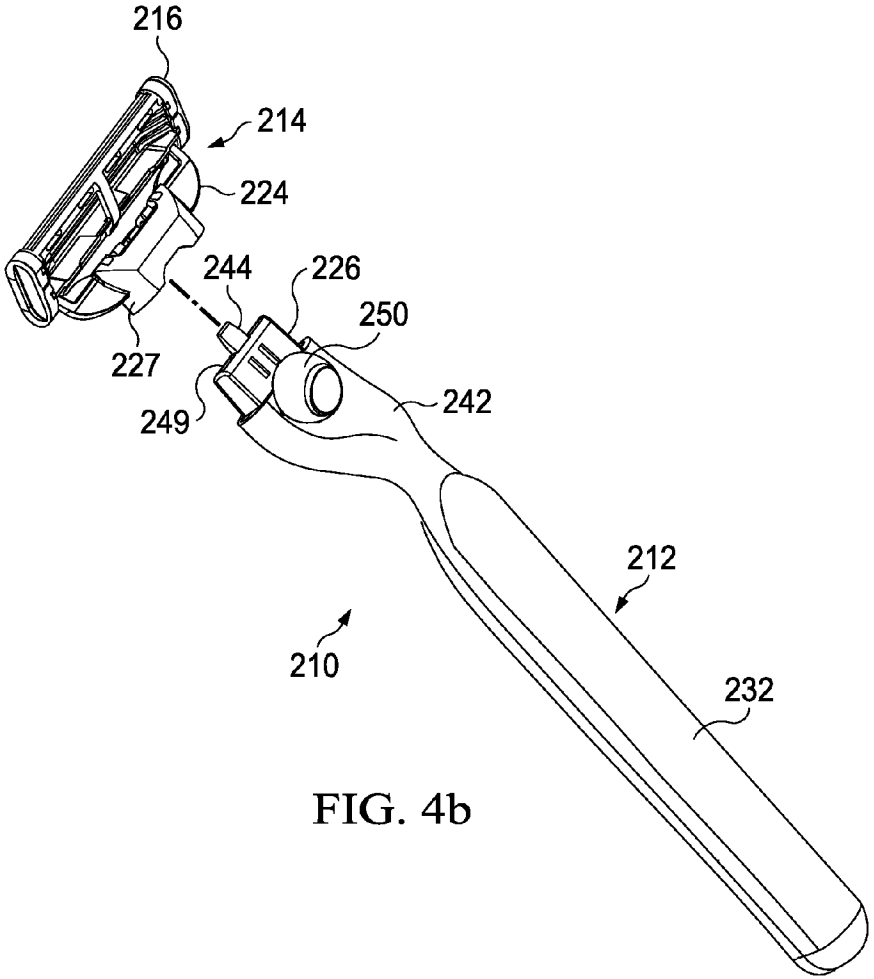

Referring to FIGS. 4*a* and 4*b*, second shaving razor configuration 210 includes shaving razor handle 212 and replaceable shaving cartridge 214. As shown in FIG. 4*b*, cartridge 214 is removable from handle 212. Cartridge 214 includes housing 216, which carries three blades 218, guard 220 and cap 222. Cartridge 214 also includes interconnect member 224 on which housing 216 is pivotally mounted. Interconnect member 224 includes base 227, and two arms 228 that pivotally support housing 216 at its two sides.

As shown in FIG. 4*b*, shaving razor handle 212 of the second shaving razor configuration includes a cartridge support structure 242 that extends from the end of elongated portion 232. Cartridge support structure 242 includes an asymmetrically shaped extension 226 (trapezoid shaped see FIG. 4*c*) which removably and fixedly attaches to asymmetrical recess in base 227 on interconnect member 224.

Cartridge support structure 242 includes components providing a spring-biased plunger action for biasing of housing 216 relative to interconnect member 224. It also includes components that provide for ejection of cartridge 214 from handle 212.

Spring-biased plunger 244 is received within recess 249 in extension 226 of cartridge support structure 242. Ejector button 250 is received in an opening on the top surface of support structure 242 that interfaces with a mechanism used to eject the razor cartridge from the support structure 242. These and other features of second shaving razor configuration 210 are described in U.S. Pat. No. 5,787,586.

Figure 7:
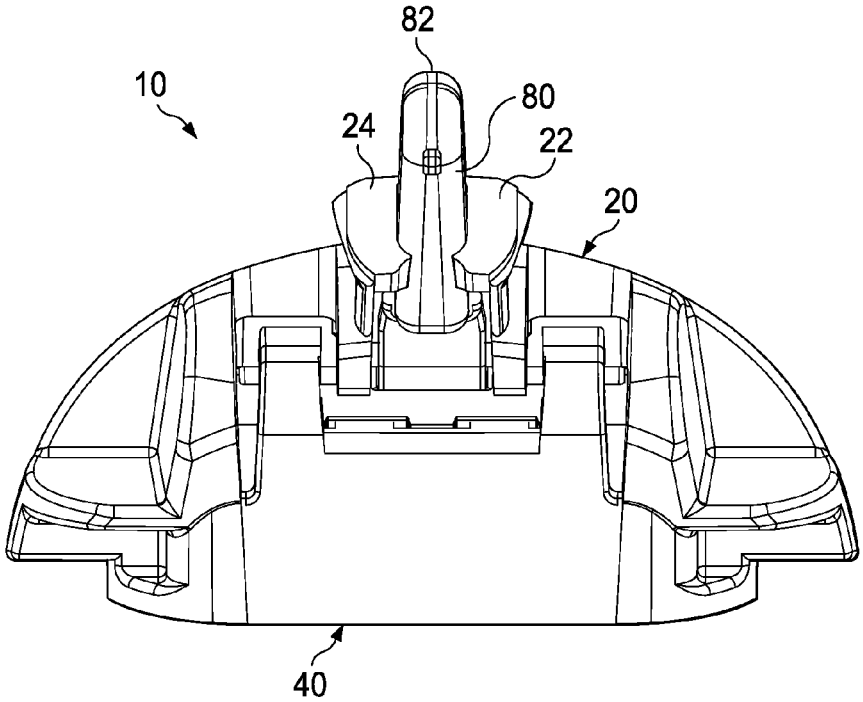
FIG. 7 is a bottom view of the shaving razor adapter embodiment according to the present invention including a slidable plunger.

The shaving razor adapter 10 according to the present invention shown in FIGS. 1*c* and 1*d* includes a recess 42 in the second attachment portion 40 that resembles the recess 42 in the base 227 of the shaving cartridge 214 of the second shaving razor configuration 210 shown in FIGS. 2*a* and 2*b*. The recess 42 enables the shaving razor handle 212 of the second shaving razor configuration 210 to interface with the adapter 10. Similar to the recess described in the base 227 of the shaving cartridge 214 of the second shaving razor configuration 210, the recess 42 in the second attachment portion 40 of the shaving razor adapter 10 can include detents 44 and 46 within recess 42 that mate with depressions in the asymmetrical extension 226. The recess 42 extends into the first attachment portion 20 of the adapter 10 enabling the spring biased plunger 244 to protrude into the first attachment portion 20 of the adapter 10. In one embodiment shown in FIG. 7, the recess 42 enables the spring biased plunger 244 to interface with a slidably mounted plunger 80 disposed in the first attachment portion 20 of the adapter 10. This embodiment is fully described below.

The first attachment portion 20 includes a projection 22 having distal end 24 and angled side surfaces 32 and 34 extending from the distal end 24 to a base 30 such that the projection 22 has an enlarged distal end 24 and the base 30 is smaller than the distal end 24. The enlarged distal end 24 of the projection 22 has a dimension greater than a dimension of an opening 178 in a connecting member 118 of the disposable shaving razor cartridge 112 of the first configuration shaving razor 110 described below.

Figure 5A:
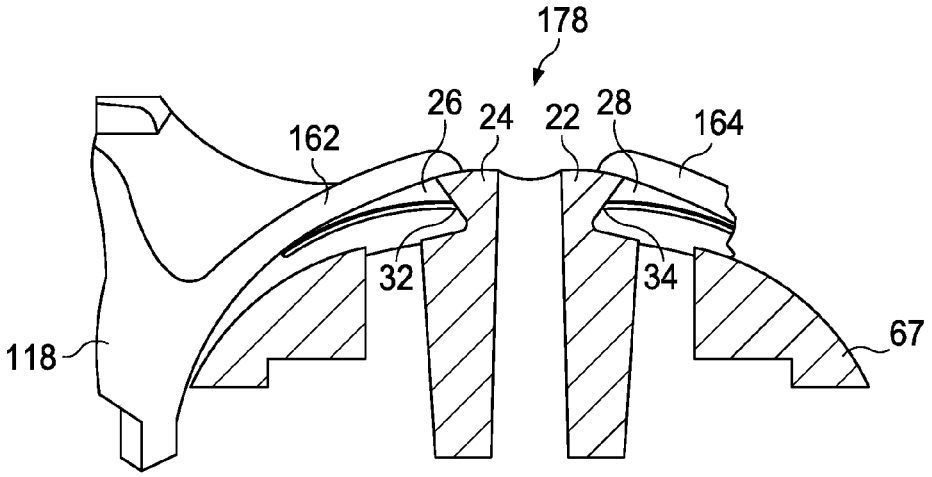
FIG. 5*a* and FIG. 5*b* are section views of the connecting structure of the shaving razor shown in FIG. 2*b*.

Referring to FIG. 5*a*, to connect the first attachment portion 20 of the shaving razor adapter 10 and connecting member 118, the user pushes the first attachment portion 20 forward into the back end of the connecting member 118. The first attachment portion 20 includes a body 67 from which a projection 22 protrudes. Projection 22 is positioned to be received by an opening 178 in the connecting member 118. As the projection 22 is inserted into the opening 178, latches 162 and 164 on the connecting member 118 elastically deflect to receive the distal end 24 of the projection 22. When the latches 162 and 164 clear outer edges 26 and 28 of the distal end 24 of the projection 22, the latches 162 and 164 recover toward their initial, undeflected position as they engage side surfaces 32 and 34 of the projection 22. The side surfaces 32 and 34 taper from the relatively large distal end 24 to a relatively smaller base 30, forming a projected apex angle alpha $\alpha$ (e.g., between about 45 and 60 degrees, such as about 52 degrees). The taper of the side surfaces 32 and 34 inhibits unintended removal of the cartridge 112 from the shaving razor adapter 10 during use. In this configuration, the shaving razor cartridge 112 cannot be removed from the first attachment portion 20 of the shaving razor adapter 10 without a spring release mechanism described below.

Figure 5B:
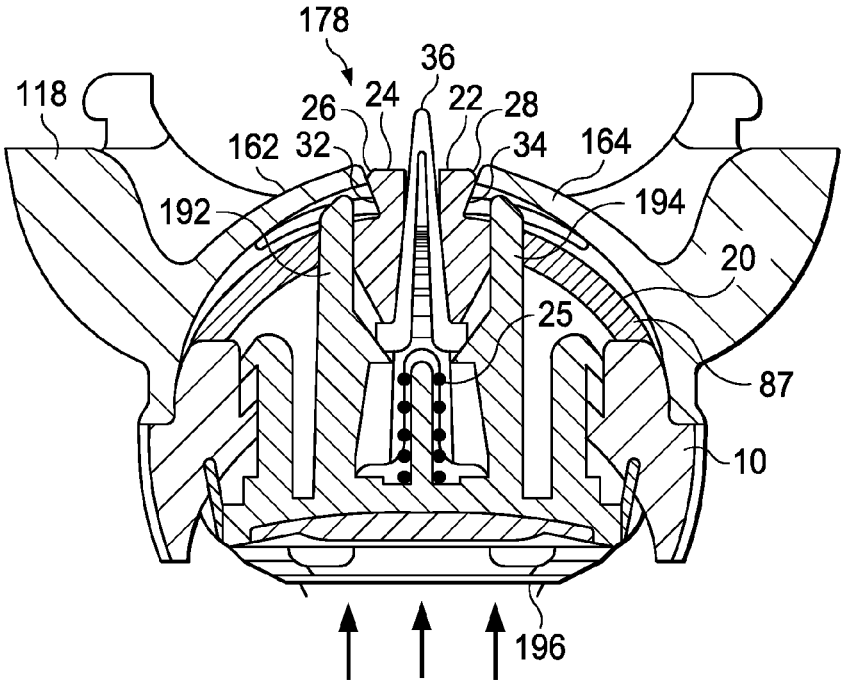

For embodiments enabling the connecting member 118 to be removed from the first attachment portion 20 of the adapter 10, the adapter 10 can include a spring release mechanism 25 shown in FIG. 5*b* similar to the mechanism used for the handle of the first shaving razor configuration described in U.S. Pat. No. 7,168,173. As shown, connecting member 118 is disconnected from the handle by actuating a spring-biased release button 196. Pressing the button 196 forward relative to adapter 10 extends pusher arms 192 and 194 into engagement with the latches 162 and 164 of the connecting member 118. This engagement forces open the interference fit between the latches 162, 164 and the projection 22 to release the cartridge 112 from the first attachment portion 20 of the adapter 10.

Figure 6A:
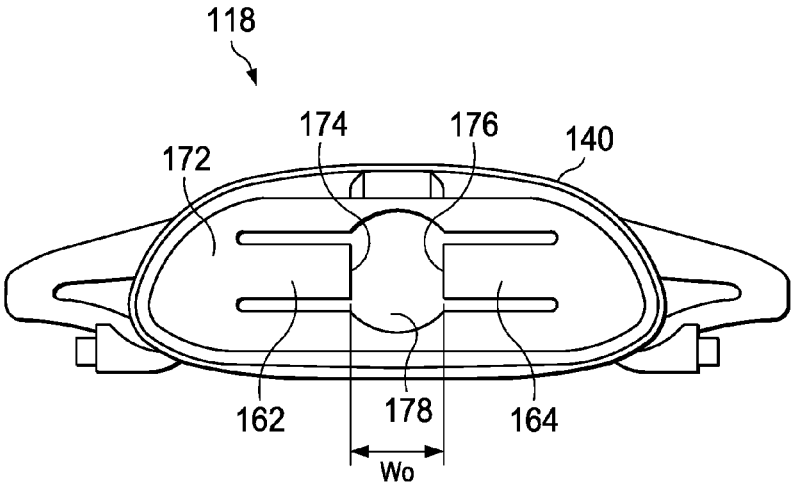
FIG. 6*a* is a rear view of the connecting member of the shaving razor cartridge of the first shaving razor configuration.
Figure 6B:
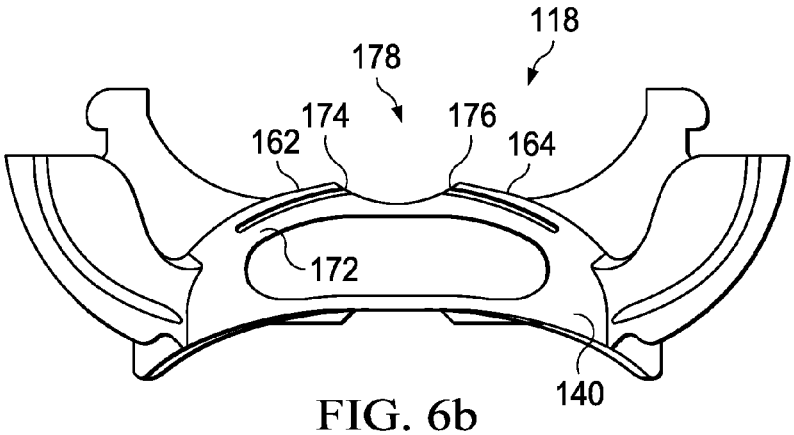
FIG. 6*b* is a side view of the connecting member of the shaving razor cartridge of the first shaving razor configuration.

Referring to FIGS. 6*a* and 6*b*, the connecting member 118 includes a body 140 from which the latches 162 and 164 extend. The body 67 of the first attachment portion 20 is contoured with an arched profile to mate with body 140 of connecting member 118, which has a correspondingly arched profile (FIG. 6*b*). The contours of the body 67 and the body 140 are also asymmetrically shaped, when viewed from the front, to assist the user in connecting the cartridge 112 to the shaving razor adapter 10 in the correct orientation. For example, referring to FIG. 6*a*, the body 140 may be generally D-shaped when seen from the front, and the body 67 of the first attachment portion 20 may have a corresponding D-shape. These corresponding arched and asymmetrical contours also inhibit relative rotation of the connecting member 118 and first attachment portion 20 of the adapter 10.

The latches 162 and 164 extend generally along the contour of and integrally from a wall 172 of the body 140 to opposing, free distal ends 174 and 176. Each distal end 174 and 176 forms a portion of an opening 178 extending through wall 172 to receive the projection 22. Referring also to FIG. 5*a*, opening 178 is smaller than the distal end 24 of projection 22. Thus, the width Wp of the distal end 24 of the projection 22 is preferably between about 4 mm and 7 mm, such as about 5.6 mm, while the width Wo between the free distal ends 174 and 176 of latches 162 and 164 is preferably between about 3 mm and 6 mm, such as about 4.8 mm.

In the embodiment shown in FIG. 1*a*, the shaving razor adapter 10 includes a leaf spring 50 attached to the first attachment portion 20. The leaf spring 50 includes a first end 52 attached to the first attachment portion 20 and a second end 54. The second end 54 extends through the opening 178 in a connecting member 118 of the disposable shaving razor cartridge 112 and interfaces with a cam surface 160 on the shaving razor cartridge 112 shown in FIG. 2*a* and 2*b*. The leaf spring 50 provides a spring force to bias housing 120 of the shaving razor cartridge 112 enabling it to return to its at rest position during use.

In another embodiment, the shaving razor adapter 10 can include a plunger attached to the first attachment portion 20. In the embodiment shown in FIG. 5*b*, the plunger includes a spring biased plunger 36 having a distal end that extends through the enlarged distal end 24 of the projection 22 interfacing with the cam surface 160 of the shaving razor cartridge 112 of the first shaving razor configuration 110. The spring biased plunger 36 is similar to the mechanism used for the handle 114 of the first shaving razor configuration described in U.S. Pat. No. 7,168,173 shown in FIG. 2*b*. In an alternate embodiment shown in FIG. 7, plunger 80 can be slidably mounted within the first attachment portion 20 of the adapter 10 and include a proximal end that interfaces with the distal end of a separate spring loaded plunger (previously described) extending from the cartridge support structure of the shaving razor handle of the second shaving razor configuration. For this embodiment, the distal end 82 of the slidably mounted plunger 80 extends through the distal end 24 of the projection 22 in the first attachment portion 20 and interfaces with the cam surface 160 on shaving razor cartridge 112 shown in FIG. 1*a*.

Materials for forming the adapter can be selected as desired. Preferably, the adapter 10 is formed of metal, such as a zinc alloy. The adapter can, however, be formed of other materials, including plastics (e.g., plated acrylonitrile-butadiene-styrene) and plastics with metal inserts. Any suitable method for forming the adapter can be employed including die casting, investment casting and molding. Suitable methods for forming include molding, such as injection molding.

The shaving razor adapter according to the present invention can be included as part of a shaving razor cartridge packaging kit. The shaving razor cartridge packaging kit comprises one or more disposable shaving razor cartridges of the first shaving razor configuration and the shaving razor adapter. The shaving razor adapter attaches the disposable shaving razor cartridge of the first shaving razor configuration to a shaving razor handle of a second shaving razor configuration. The one or more shaving razor cartridges and the shaving razor adapter are packaged in a common package.

For this embodiment, packaging including the shaving razor adapter and one or more shaving razor cartridges of the first shaving razor configuration can be distributed to consumers using the second shaving razor configuration as a promotion to get them to try the shaving razor cartridge of the first shaving razor configuration.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor adapter for attaching a disposable shaving razor cartridge of a first shaving razor configuration to a shaving razor handle of a second shaving razor configuration, the shaving razor cartridge of the first shaving razor configuration comprising a connecting member including deflectable latches defining a portion of an opening through the connecting member and the shaving razor handle of the second shaving razor configuration comprising a cartridge support structure including an asymmetrically shaped extension, the shaving razor adapter comprising:

a. a first attachment portion configured to attach to the connecting member of the shaving razor cartridge of the first shaving razor configuration, the first attachment portion comprising a projection having an enlarged distal end and angled side surfaces extending from the enlarged distal end to a base wherein the base is smaller than the distal end, wherein the enlarged distal end of the projection is received by the opening in the connecting member by elastically deflecting the deflectable latches; and b. a second attachment portion configured to attach to the shaving razor handle of the second shaving razor configuration, the second attachment portion comprising an asymmetrically shaped recess resembling the cartridge support structure asymmetrically shaped extension of the shaving razor handle of the second shaving razor configuration, wherein the recess releasably attaches the adapter to the shaving razor handle, wherein the second attachment portion is opposite the first attachment portion.

2. The adapter according to claim 1 wherein the angled side surfaces of the projection have a projected apex angle of between 45 and 60 degrees.

3. The adapter according to claim 1 wherein the first attachment portion includes a leaf spring attached to the first attachment portion and extending therefrom, wherein the leaf spring extends through the opening in the connecting member and interfaces with a cam surface to bias a housing of the shaving razor cartridge.

4. The adapter according to claim 1 wherein the shape of the recess is substantially trapezoidal.

5. The adapter according to claim 1 wherein the shape of the recess has six sides.

6. A shaving razor adapter for attaching a disposable shaving razor cartridge of a first shaving razor configuration to a shaving razor handle of a second shaving razor configuration, the shaving razor cartridge of the first shaving razor configuration comprising a housing having a front edge and a rear edge; one or more shaving blades between the front edge and the rear edge of the housing; a cam surface opposite the one or more shaving blades and a connecting member comprising a deflectable element defining at least a portion of an opening through the connecting member; the shaving razor handle of the second shaving razor configuration comprising a cartridge support structure including an asymmetrically shaped extension, the shaving razor adapter comprising:

a. a first attachment portion configured to attach the adapter to the connecting member of the shaving razor cartridge, the first attachment portion including a projection sized to be received by the opening extending through the connecting member of the shaving razor cartridge, wherein the projection has an enlarged distal end and angled side surfaces extending from the enlarged distal end to a base wherein the base is smaller than the distal end, the enlarged distal end of the projection having a dimension greater than a dimension of the opening such that inserting the projection into the opening deflects the deflectable element to secure the connecting member to the first attachment portion; and b. a second attachment portion releasably attaching the adapter to the shaving razor handle of the second shaving razor configuration, the second attachment portion comprising an asymmetrically shaped recess resembling the cartridge support structure asymmetrically shaped extension, wherein the second attachment portion is opposite the first attachment portion.

7. The adapter according to claim 6 wherein the angled side surfaces of the projection have a projected apex angle of between 45 and 60 degrees.

8. The adapter according to claim 6 wherein the first attachment portion includes a leaf spring attached to the first attachment portion and extending therefrom, wherein the leaf spring extends through the opening in the connecting member and interfaces with the cam surface to bias the housing.

9. The adapter according to claim 6 wherein the first attachment portion includes a spring biased plunger, wherein the plunger extends through the opening in the connecting member and interfaces with the cam surface to bias the housing.

10. The adapter according to claim 6 wherein the second attachment portion comprises an asymmetrically shaped recess and the razor handle of the second shaving razor configuration includes a cartridge support structure including an extension shaped to mate with the recess wherein proper orientation of the adapter is maintained with respect to the handle.

11. The adapter according to claim 6 wherein the first attachment portion is releasably attached to the connecting member of the shaving razor cartridge.

12. A shaving razor adapter for attaching a disposable shaving razor cartridge of a first shaving razor configuration to a shaving razor handle of a second shaving razor configuration, the shaving razor cartridge comprising a housing having a front edge and a rear edge; one or more shaving blades between the front edge and the rear edge of the housing; a cam surface opposite the one or more shaving blades and a connecting member comprising a deflectable element defining at least a portion of an opening through the connecting member; the shaving razor handle comprising a cartridge support structure comprising an asymmetrically shaped extension and a spring biased plunger including a cam follower surface extending from the extension; the shaving razor adapter comprising:

a. a first attachment portion comprising a projection sized to be received by the opening extending through the connecting member, wherein the projection has an enlarged distal end and angled side surfaces extending from the enlarged distal end to a base wherein the base is smaller than the distal end, the enlarged distal end of the projection having a dimension greater than a dimension of the opening such that inserting the projection into the opening deflects the deflectable element to secure the connecting member to the first attachment portion; the projection includes an aperture through the distal end of the projection and a slidable plunger having a first end comprising a cam follower extending through the aperture and a second end slidably mounted to the first attachment portion; and b. a second attachment portion comprising an asymmetrically shaped recess configured to interface with the asymmetrically shaped extension of the cartridge support structure, wherein the asymmetrically shaped recess extends through the adapter from the second attachment portion to the first attachment portion wherein the spring biased plunger extends through the recess and the cam follower surface of the spring biased plunger interfaces with the second end of the slidable plunger slidably mounted in the first attachment portion, wherein the cam follower surface of the slidable plunger interfaces with the cam surface on the housing to bias the housing.

13. The adapter according to claim 12 wherein the angled side surfaces of the projection have a projected apex angle of between 45 and 60 degrees.

14. A shaving razor cartridge packaging kit comprising a disposable shaving razor cartridge of a first shaving razor configuration and a shaving razor adapter attaching the disposable shaving razor cartridge to a shaving razor handle of a second shaving razor configuration wherein the shaving razor cartridge and the shaving razor adapter are packaged in a common package, wherein the disposable shaving razor cartridge of the first shaving razor configuration comprises a housing having a front edge and a rear edge; one of more shaving blades between the front edge and the rear edge; a cam surface opposite the one or more shaving blades; and a connecting member comprising a deflectable element defining at least a portion of an opening through the connecting member, wherein the shaving razor adapter comprises a first attachment portion attaching to the opening in the connecting member of the shaving razor cartridge, wherein the first attachment portion comprises a projection having an enlarged distal end and angled side surfaces extending from the enlarged distal end to a base wherein the base is smaller than the distal end; and a second attachment portion attaching the adapter to the shaving razor handle, wherein the second attachment portion is opposite the first attachment portion, and wherein the angled side surfaces of the projection have a projected apex angle of between 45 and 60 degrees.

15. The shaving razor cartridge kit according to claim 14, wherein the second attachment portion comprises a recess, wherein the recess releasably attaches the adapter to the shaving razor handle.

16. The adapter according to claim 14 wherein the first attachment portion includes a leaf spring attached to the first attachment portion and extending therefrom, wherein the leaf spring extends through the opening in the connecting member and interfaces with the cam surface to bias the housing.

* * * * *